United States Patent [19]

Ward et al.

[11] 4,027,611

[45] June 7, 1977

[54] SEAM FORMING APPARATUS

[75] Inventors: Donald H. Ward, Middletown; John K. Buffenbarger, Monroe, both of Ohio

[73] Assignee: Armco Steel Corporation, Middletown, Ohio

[22] Filed: Apr. 22, 1976

[21] Appl. No.: 679,451

[52] U.S. Cl. ..... 113/54 R; 113/58

[51] Int. Cl.[2] ..... B21D 37/00

[58] Field of Search ..... 113/1 N, 54 R, 55, 58; 29/243.5

[56] References Cited

UNITED STATES PATENTS

| | | | |
|---|---|---|---|
| 3,528,167 | 9/1970 | Lipp | 29/243.5 |
| 3,771,482 | 11/1973 | Thompson | 113/55 |
| 3,797,430 | 3/1974 | Boudreau | 113/55 |
| 3,875,642 | 4/1975 | Knudson | 113/58 |

*Primary Examiner*—Michael J. Keenan

*Attorney, Agent, or Firm*—Melville, Strasser, Foster & Hoffman

[57] ABSTRACT

A seam forming apparatus for forming standing seams to interconnect pairs of adjacent metallic panels.

10 Claims, 9 Drawing Figures

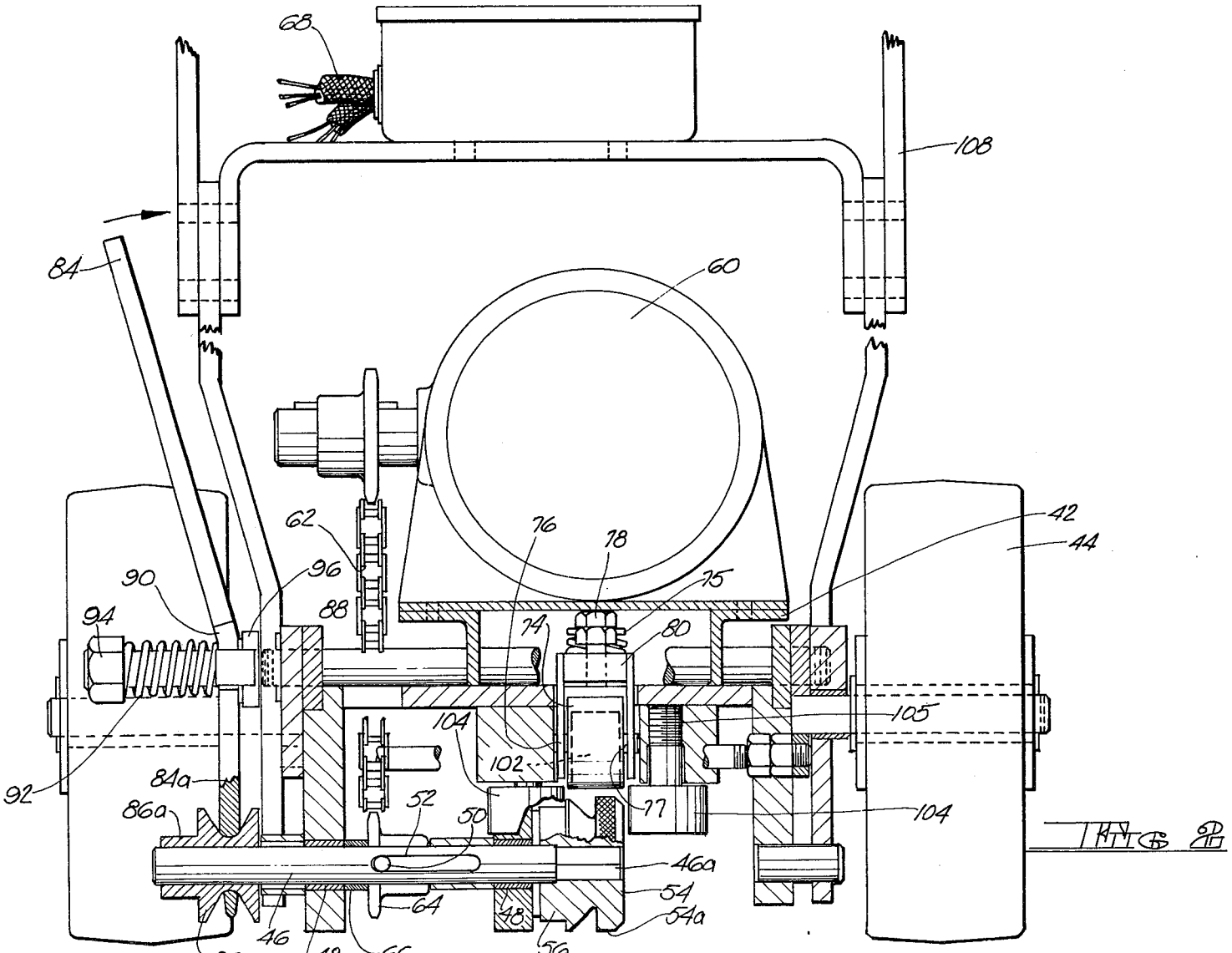
108
42
44
105
104
60
75
80
77
46a
54
54a
78
76
74
102
104
56
48
50
52
64
66
48
68
62
96
88
46
86
84a
86a
90
94
84
92

SEAM FORMING APPARATUS

BACKGROUND OF THE INVENTION

1. Field of the Invention

This invention relates in general to preengineered metal buildings and particularly to metal buildings having building panels of the standing seam type. More specifically, the invention relates to an improved machine for forming or crimping and thereby sealing standing seams of adjacent side edges of two such building panels.

2. Description of the Prior Art

In an earlier filed patent application, Ser. No. 581,909, now pending, there is shown and described unique U-shaped building panels which include a surface portion and an upstanding rib along each longitudinal edge of the surface portion. In general, the ribs are configured to mate with the corresponding rib of an adjacent panel. In practice, each of the ribs on a given panel generally includes an inverted U portion, and the rib along one edge of the panel, the female rib, is arranged with the U portion extending outwardly of the surface portion of the panel, while the U portion of the opposite rib, the male rib, extends inwardly being disposed above the surface portion of the panel. Accordingly, when mating ribs of adjacent panels are engaged together, the surface portions of the adjacent panels will abut one another in a single plane.

The prior art has long been concerned with developing a fully satisfactory way of securing panels similar to the aforementioned adjacent panels together, as well as with developing a tool therefor. As background, it will be understood that in certain cases, wherein extra rigidity was required, or wherein the seams between adjacent panels were caulked, the prior art has utilized screws through the surface portion of the panels which are parallel to the ribs of the panels. Additionally, the possibilities of leaks in the panel system were greatly increased.

In order to avoid the use of screws, the prior art did develop miscellaneous tools which would simultaneously engage the rib portion of adjacent panels, force them into their proper relationship, and crimp to secure them in that position. However, such tools have proved to be unsatisfactory because they have been of the hand type mechanical crimper variety, which could deform only a small area of the female rib, or they were machines which could not be disengaged from the rib or seam in any desired place along the length of the sheet flange or they were unable to connect building panels to one another in a fast and efficient manner and form a strong water-tight, weather resistant rib or seam.

Finally, and specifically with reference to the building panels of pending application Ser. No. 581,909, it is important to note that customers may often specify that a roof composed of such panels must meet the class 90 specifications of the Underwriters Laboratory. In order to, for example, pass the class 90 specifications when using 24 gauge panels, the ribs or standing seams of such 24 gauge panels must be deformed or held together with a 45° crimp. However, apparatus presently available is unable to connect such panels to one another in a fast and efficient manner with a 45° crimp. Accordingly, it has been necessary to utilize building panels of heavier gauge which can readily meet the rigid class 90 specifications of the Underwriters Laboratory without utilizing the 45° crimp.

SUMMARY OF THE INVENTION

The present invention provides a seam forming apparatus for forming standing seams to interconnect pairs of adjacent metallic panels. The apparatus includes a wheeled carriage having a horizontal drive shaft rotatably mounted to the underside thereof. A drive roller, having a surface to frictionally engage the underside of the standing seam being formed, and a forming roller, having a peripheral configuration to perform the forming, are coaxially mounted nonrotatably on the drive shaft. A pressure roller is mounted on a shaft substantially parallel to the drive shaft directly above the drive rollers so that during the operation of the apparatus, that portion of the standing seam to be formed that is not formed, is squeezed between the pressure and drive rollers. Means are provided to release the pressure roller and means are provided for guiding the carriage along the standing seam. Finally, means are provided for driving the drive roller.

In a preferred embodiment the drive and forming rollers are nonrotatably mounted on an end of the drive shaft but are axially shiftable thereon, and means are provided to shift the drive shaft axially. Accordingly, the drive and forming rollers are stripped from the drive shaft when the drive shaft is moved axially and withdrawn from the drive and forming rollers. In this way, when the pressure roll is released and the drive and forming rollers are stripped from the drive shaft, the seam forming apparatus may readily disengaged from the standing seam at any desired place along the length of the sheet flanges or seam.

BRIEF DESCRIPTION OF THE DRAWING

FIG. 2 is a cross sectional view of the seam forming apparatus, taken along the line 2—2 of FIG. 3.

DESCRIPTION OF THE PREFERRED EMBODIMENTS

Figure 1:
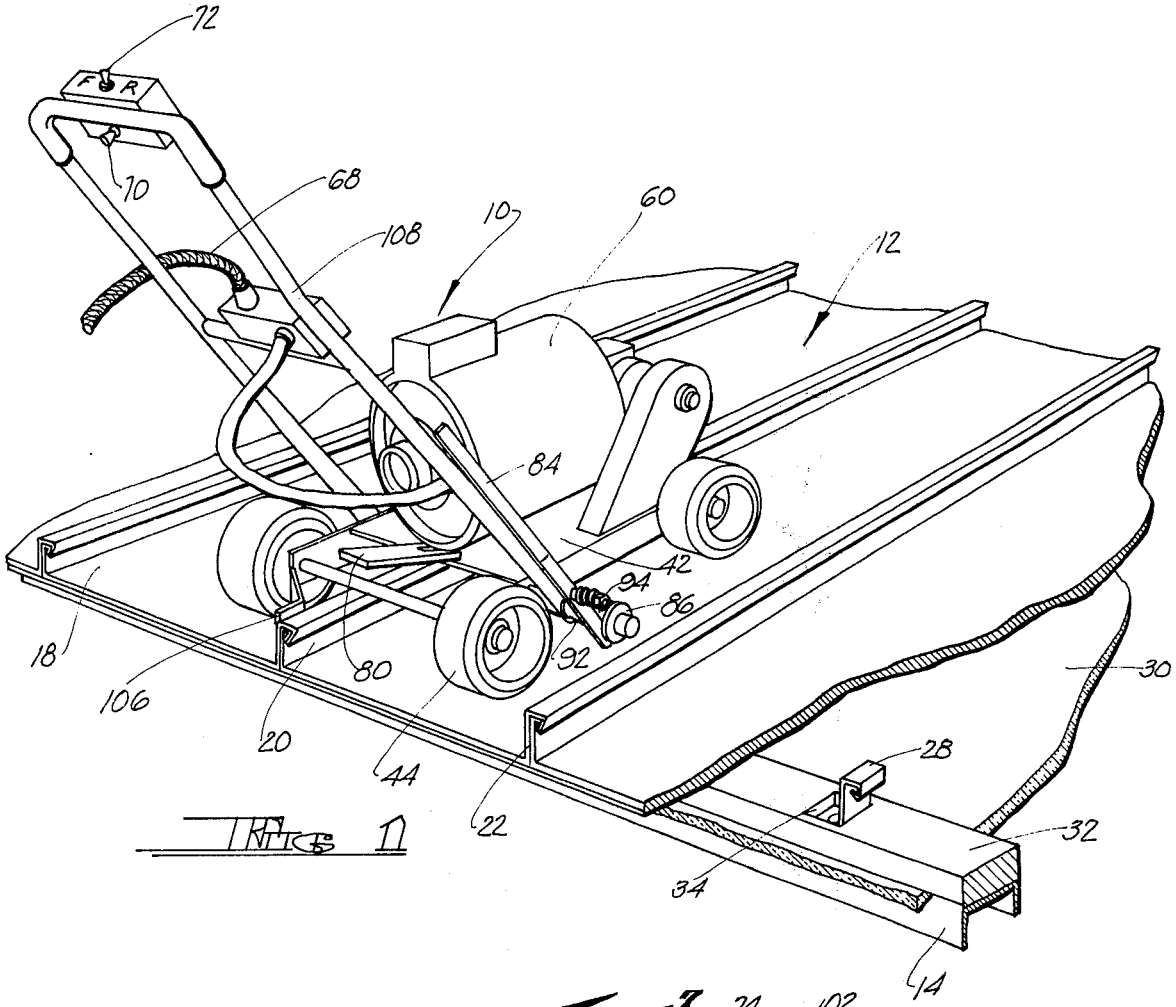
FIG. 1 is a perspective view showing fragments of two similar building panels that are being joined side by side by a seam forming apparatus constructed in accordance with the present invention.
Figure 6:
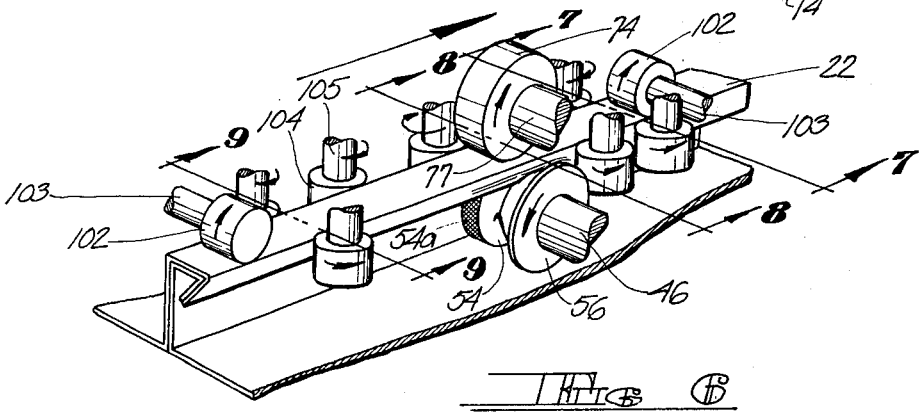
FIG. 6 is a fragmentary perspective view showing the arrangement of the rollers of the seam forming apparatus and their direction of rotation in relation to the two building panels being joined.
Figure 3:
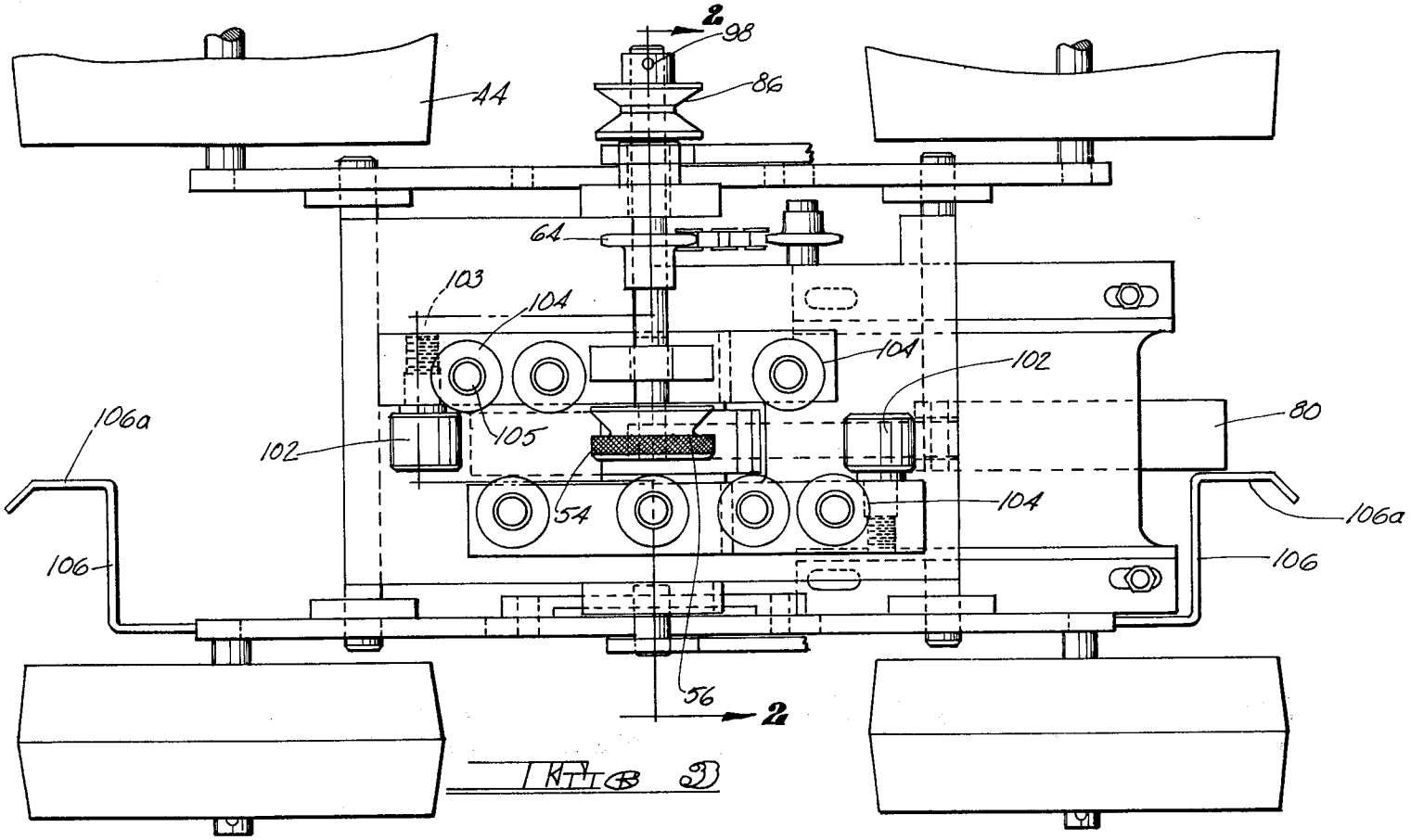
FIG. 3 is a bottom plan view of the seam forming apparatus.
Figure 5:
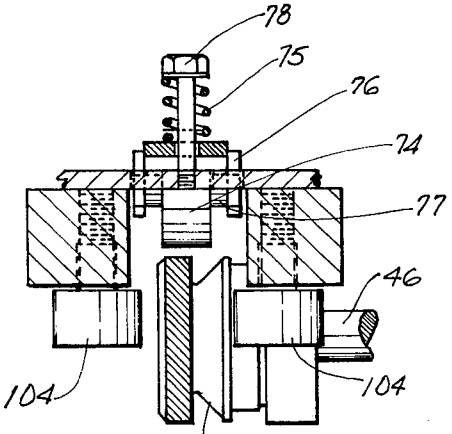
FIG. 5 is a cross sectional view taken on the line 5—5 of FIG. 4.
Figure 4:
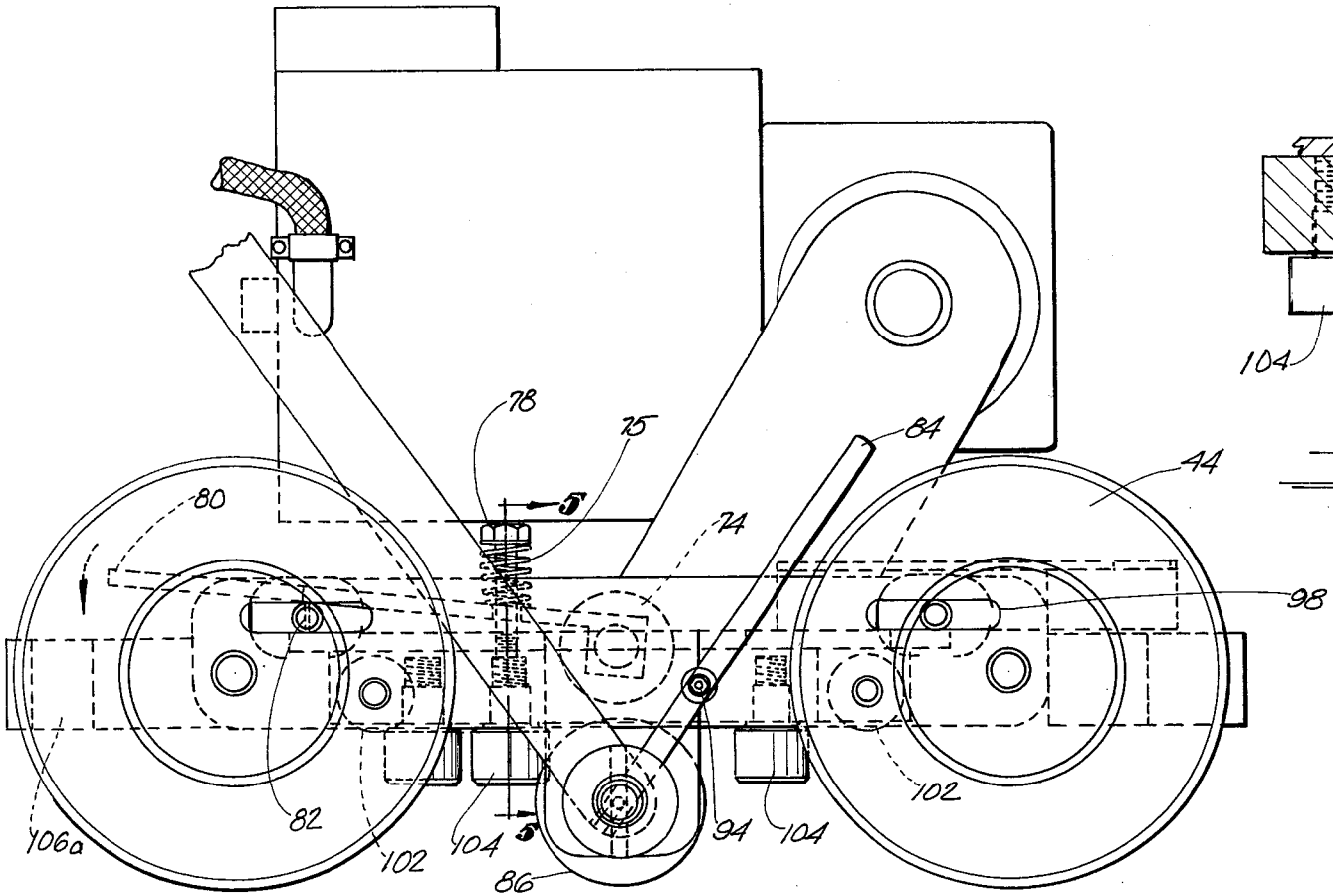
FIG. 4 is a side elevational view of the seam forming apparatus shown in FIG. 1.
Figure 8:
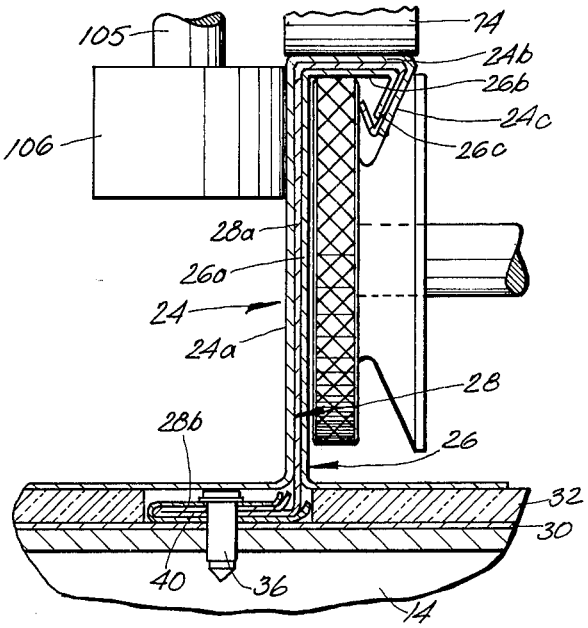
FIG. 8 is a cross sectional view taken along the lines 8—8 of FIG. 6.
Figure 7:
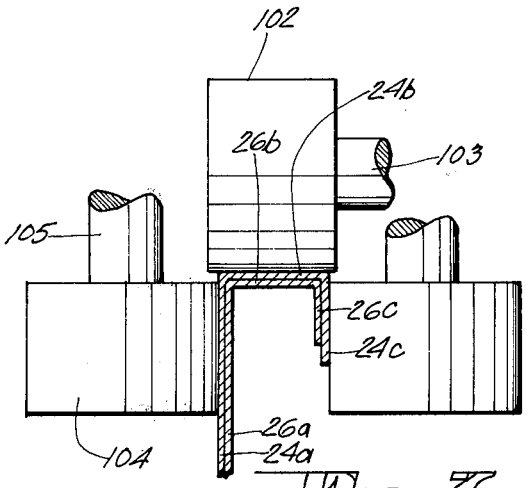
FIG. 7 is a cross sectional view taken along the lines 7—7 of FIG. 6.
Figure 9:
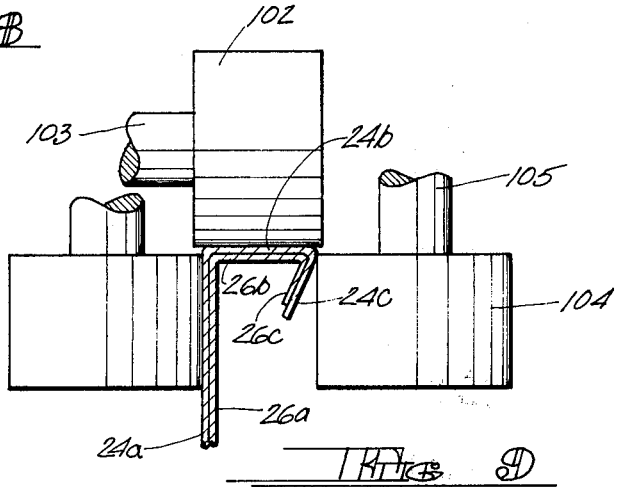
FIG. 9 is a cross sectional view taken along the line 9—9 of FIG. 6.

Referring now to FIG. 1, there is shown a self-propelled seam forming apparatus 10 made in accordance with the present invention mounted in an operative position for connecting two building panels 12. A typical building structure may include a series of pairs of relatively stiff and rigid interlocked metal panels 12 of channel configuration and self-supporting capacity affixed to and closing the space between space supporting members, such as, for example, the purlin 14, and clip connectors 28, which are of a relatively shorter lenght than the coupled panels 12, anchor the coupled panels 12 to the purlins 14.

Each of the panels 12 is provided with a central web surface 18 and a pair of side walls 20 projecting outwardly from opposing edges of the web 18 to form inverted channel-shaped ribs along the abutting edges of the panels 12 adapted to form rib joints or standing seams 22. Each rib joint or standing seam 22 has an inverted channel shaped female member 24 secured along the edge of one panel 12 and a corresponding inverted channel-shaped male member 26 secured along the edge of an adjacent panel 12. The male and female members 26 and 24, respectively, have corresponding upstanding members **26*a* and 24*a* projecting from the abutting edges, corresponding upper portions 26*b* and 24*b*, and deformable flange hook portions 26*c* and 24*c* extending downwardly from the upper portions 26*b* and 24*b*, respectively, toward but not contacting the web surface 18 of the panels 12**.

During field assembly, the female member 24 is capable of overlying the male member 26 with the outer surface of the corresponding upstanding members **26*a*, 24*a* and upper portions 26*b* and 24*b* of the male and female members 26 and 24, respectively, adapted to mate throughout their lengths, and the deformable flange hook portions 26*c* and 24*c* of the male and female members 26 and 24, respectively, are capable of being deformed so as to conform intimately to effect continuous, positive interlocking of male and female ribs 26 and 24**.

Clip connectors 28 of relatively shorter length than the coupled panels 12 are provided anchoring the coupled side walls 20 and the panels 12 provided therewith to the supporting members 14. Each clip connector 28 includes a body portion **28*a* tightly sandwiched between associated corresponding upstanding members 24*a* and 26*a*, upper portions 24*b*, 26*b* and flange hook portions 24*c*, 26*c* of the side walls 20 of the coupled panels 12, and a foot 28*b* at the end of the body portion 28*a* of the clip connector 28 anchored to a supporting member 14 and fastening the connector 28 along with the coupled panels 12 to the supporting member 14. The foot 28*b* of the clip connector 28 guarantees centering during installation and provides for movement of the joined panels 12 with respect to the plurality of spaced supporting members 14** during thermal movement of the panels.

As shown in FIG. 1, suitable insulation 30, such as blanket or roll insulation, is utilized over the supporting members 14, and rectangular insulation strips 32, of a width substantially identical to the width of the supporting members 14 and preferrably of a dense nonmetallic substance, such as, for example, urethane, having aperatures or slots 34, are then laid on the spaced members 14. The web surfaces 18 of a run of panels 12 are then placed against the insulation 30 and 32. Thereafter, the clip connectors 28 are rotatably and shiftably positioned over the male member 26 of each panel 12, with the body portion **28*a* of the clip connector in engagement with the upstanding members 26*a*, the upper portions 26*b* and the flange hook portions 26*c* of the male members 26 of the panels 12, and the foot 28*b* of each clip connector 28 fitting into the slot 34 in the rectangular insulation strip 32. A self drilling screw 36 is then directed through each of the apertures 40 of the clip connectors 28 into a supporting member 14 to secure the foot 28*b* of each clip connector 28 thereto. Following the setting of the screws 36, the female member 24 of a panel 12 is overlaid upon the male member 26, with the body portion 28*a* of the clip connector sandwiched between the upstanding members 24*a*, 26*a* and the upper portions 24*b* and 26*b* of the female and male members 24 and 26, respectively. An initial hand crimp is completed at the building edge to enable the seam forming apparatus 10 to get started. Additional hand crimping, such as at the clip connectors 28 may be done to hold the panel 12, but is normally unnecessary. It has been found that the angle of the crimp should not preferably exceed 45°. An electric power crimping or forming device, such as the seam forming apparatus 10 of the present invention, follows and completes the crimping or forming operation along the entire length of the rib or seam 22, thus forming the deformable flange hook portions 24*c* and 26*c* of the female and male members 24 and 26, respectively, to conform intimately to effect continuous, positive interlocking of the female and male members 24 and 26 to form the rib or seam 22**.

The seam forming apparatus 10 of the present invention comprises a carriage 42 having wheels 44. The wheels 44 may, of course, be made of any satisfactory material. However, it has been found that Polylast wheels facilitate easy movement of the seam forming apparatus 10, particularly when the apparatus is used upon a roof.

A horizontal drive shaft 46 is rotatably mounted in bearings 48 to the underside of the carriage 42. A drive roller 54, having a surface **54*a* to frictionally engage the underside of the upper portion 26*b* of the male member 26 of the rib joint or standing seam 22, as well as a forming roller 56, having a peripheral configuration to perform the crimping or forming, are coaxially mounted nonrotatably, on the end 46*a* of the drive shaft 46. This may be accomplished in several ways, such as for example by way of keying or by making the end 46*a* of the shaft 46 noncircular and by providing mating aperatures in the drive and forming rollers 54 and 56. As will be more fully explained hereinafter, the drive and forming rollers 54 and 56, respectively, are shiftable axially so that they may be stripped from the end 46*a* of the shaft 46 when the end of the drive shaft 46** is withdrawn.

A motor 60 is mounted on top of the carriage 42 and is connected through suitable drive means, including the sprocket chain 62, to a drive sprocket 64 nonrotatably secured between the spacers 66 on the drive shaft 46. The pin 50, which extends through the slot 52 in the drive shaft 46, joins the drive sprocket 64 to the drive shaft 46. However, the drive shaft 46 is shiftable axially with respect to the drive sprocket on amount equal to the length of the slot 52. The motor 60 as shown in the drawings is an electric motor connected to a suitable power source by way of the cable 68. It will, be understood that any suitable means may be utilized for driving the drive roller 54. The motor 60 is, of course, provided with a suitable on and off switch 70 as well as with a forward and reverse switch 72.

A pressure roller 74 is mounted within the bracket 76, on a shaft 77 substantially parallel to the drive shaft 46, directly above the drive roller 54 so that during the operation of the seam forming apparatus 10, that portion of the rib joint or standing seam 22 to be formed that is not formed, i.e., the upper portions **24*b* and 26*b* of the female and male members 24 and 26**, respectively, is squeezed between the pressure and drive rollers 74 and 54, respectively. The pressure roll 74 is preferrably biased by the spring 75, the tension of which may be controlled by the nut 78. Since the pressure roll 74 is spring biased, it is self-adjusting so that metal thicknesses being crimped can vary from a minimum of one thicknesses to a maximum of three thicknesses.

Means are provided to release the pressure roller 74. As can be seen, a suitable foot actuated lever 80, with the fixed bar member 82 acting as a fulcrum, may be depressed downwardly, in the direction indicated arrow, against the spring 75, thus raising the pressure roll 74.

As previously indicated, the drive and forming rollers 54 and 56, respectively, may be stripped from the end 46*a* of the drive shaft 46 when the end of the drive shaft 46 is withdrawn through the aperatures in the drive and forming rollers 54 and 56 into the adjacent end of the outer shaft. This is accomplished by means of the arm 84. As can be seen, the arm or release handle 84 is rotatably secured to the drive shaft 46 through the wheel 86, which is nonrotatably secured to the outer surface thereof. A rod 88 secured to the carriage 42 projects through the aperature 90 in the arm or release handle 84. A spring 92, the tension of which may be controlled by the nut 94, holds the arm 84 against the spacer 96.

When the arm 84 is depressed, as indicated by the arrow in FIG. 2, the drive shaft 46 is caused to shift to the left. In so doing, the end 46*a* of the drive shaft 46 is withdrawn through the aperatures in the drive and forming rollers 54 and 56, respectively, thus causing the drive and forming rollers 54 and 56, to drop from the end 46*a* of the drive shaft 46.

Suitable means are provided for guiding the carriage 42 along the rib joint or standing seam 22. In general, such means includes the upper carriage or support rolls 102, the guide rolls 104 and the guide members 106. Each upper carriage or support roll 102 is rotatably mounted on a shaft 103 substantially parallel to the drive shaft 46 such that the roll 102 rides on the outside surface of the upper portion 24*b* of the female member 24 of the joint of seam 22. Each roll 104 is rotatably mounted on a shaft 105 substantially perpendicular to the drive shaft 46 such that during the operation of the seam forming apparatus 10 each roll 104 will be continguous with the upstanding member 24*a* or the deformable flange hook portion 24*c* of the female member 24 of the joint or seam 22. The guide members 106 extend from the carriage 42 such that a portion 106*a* thereof is juxtaposed and substantially contiguous with the upstanding member 24*a* of the female member 24 of a rib or seam 22.

The seam forming apparatus 10 is provided with a reversible handle 108 so that the apparatus 10 is capable of traversing a joint or seam 22 both forward and backward and precludes having to turn the apparatus 10 around at the end of a rib or seam 22 before starting on the next one. Since the forming roller 56 and the guide rolls 104 are underneath and in the middle of the apparatus 10, the rear two wheels 44 support the entire weight of the apparatus 10 at the roof overhang when starting on a new rib or seam 22. The slots 98 in the carriage 42 allow the carriage 42 to be moved encrementally forward, independently of the wheels 44, in an amount equal to the length of the slots 98, when the handle is reversed. Accordingly, this enables one to crimp very close to the end of a rib 22 in those situations where an obstruction, such as a roof vent or the like, is present.

In operation, the seam forming apparatus 10 is merely rolled up to the edge of, for example, a roof and engaged with the rib or seam 22. This is accomplished by the depressing the lever 80, which releases the pressure roller 74, and then by moving the carriage 10 so as to allow the upper portions 24*b* and 26*b* of the female and male members 24 and 26 of the rib or seam 22 to be located between the rollers 74 and 54. The lever 80 is then released so that the upper portions 24*b* and 26*b* of the female and male members 24 and 26, respectively, are squeezed between the pressure and drive rollers 74 and 54, respectively. The switch 72 is then moved to the appropriate forward or reverse position and the switch 70 is turned to the on position. The operator for the first few feet of operation, walks backward with the seam forming apparatus 10. Thereafter, he merely reverses the handle 108 and follows the apparatus 10 for the remainder of the forming or crimping operation on a particular rib or seam 22.

If it is desired to remove the crimper from the rib or seam 22 midway of the length thereof, the switch 70 is moved to the off position. The lever 80 is then depressed so that the pressure roll 74 is released. At the same time the arm 84 is compressed so that the drive and forming rollers 54 and 56, respectively, may drop from the end 46*a* of the drive shaft 46 when the end 46*a* of the drive shaft 46 is withdrawn through the aperatures in the rollers 54 and 56. As soon as the drive and forming rollers 54 and 56 are removed from the end 46*a* of the drive shaft 46, the apparatus 10 can be lifted over the rib or seam 22 and wheeled to the next rib or seam 22 to be formed.

It should, of course, be noted that the seam forming apparatus 10 of the present invention has its center of gravity approximately in the middle, whereby the weight thereof acts directly on top of the rib or seam 22, precluding torque thereon.

It should also be noted that the motor 60 on the seam forming apparatus 10 of the present invention is preferrably a ¾ HP motor, and that with this size motor the seam forming apparatus 10 has been found capable of consistently forming or crimping two thicknesses of metal plus the concealed clips at a speed of 2 miles/hr. or approximatly 175 ft/min. Such speed far surpasses the speed of prior art forming or crimping apparatus, generally in the range of 40–60 ft/min. while forming or crimping one thickness of metal.

Prior art forming or crimping apparatus require the use of several driving rolls. However, the seam forming apparatus 10 of the present invention utilizes only one knurled drive wheel or roller 54 to perform at least as much work and yet operate at speeds greatly in excess of prior art crimpers or forming apparatus. As previously pointed out, in addition to one driving roll 54 and one forming roll 56, the seam forming apparatus 10 of the present invention has two upper carriage or support rolls 102, one pressure roll 74 and seven guide rolls 104. It will, of course, be understood that the number of such rolls could be more or less.

As previously indicated, the release of the pressure roll 74, by depressing the lever 80, and the release of the drive and forming rollers 54 and 56, through activation of the arm 84, permits the seam forming apparatus 10 to be quickly and easily removed or engaged in the middle of a rib or seam 22. There are times when this becomes necessary. For example, if the panels 12 are roof panels and the roof has vents, the seam forming apparatus 10 must be disengaged from the rib or seam 22 on one side of the vent and begun again on the other side. If swaged joints are present, such as for large roofing systems, the apparatus 10 may experience difficulty in forming five or more thicknesses of metal. In this instance, the apparatus 10 may be disengaged to move across the joint.

Although the present invention has been described with a certain degree of particularity, it is understood that the present disclosure has been made by way of example and the changes and details of structure may be made without departing from the spirit thereof. For example, while the application has shown the drive and forming rolls 54 and 56 mounted on a single drive shaft 46 it will be understood that this is only the preferred embodiment of the seam forming apparatus 10, and that the drive and forming rollers 54 and 56 could be mounted on separate drive shafts.

We claim:

1. A seam forming apparatus for forming standing seams to interconnect pairs of adjacent metallic panels, which comprises:

a. a wheeled carriage;

b. a horizontal drive shaft rotatably mounted to the underside of said carriage;

c. a drive roller, said drive roller having a surface to frictionally engage the underside of said standing seam being formed;

d. a forming roller, said forming roller having a peripheral configuration to perform said forming, said drive and forming rollers being coaxial and mounted nonrotatably on an end of said drive shaft but axially shiftable thereon;

e. means to shift said drive shaft axially, whereby said drive and forming rollers are stripped from said drive shaft when said drive shaft is moved axially and withdrawn from said drive and forming rollers;

f. means for driving said drive roller;

g. a pressure roller mounted on a shaft substantially parallel to said drive shaft directly above said drive roll so that during the operation of said apparatus, that portion of said standing seam to be formed that is not formed is squeezed between said pressure and drive rollers;

h. means to release said pressure roller; and i. means for guiding said carriage along said standing seam.

2. The apparatus according to claim 1 including means to remove said drive and forming rollers from said drive shaft.

3. The apparatus according to claim 1, wherein said pressure roller is spring biased.

4. The apparatus according to claim 3, wherein said means to release said pressure roller comprises a lever which retracts said pressure roller against the action of said spring.

5. The apparatus according to claim 1, wherein said means for guiding said carriage along said standing seam comprises at least one upper support roll rotatably mounted on a shaft on the underside of said carriage, said shaft being substantially parallel to said drive shaft such that said support roll rides on the outside surface of said standing seam being formed.

6. The apparatus according to claim 5, wherein said means for guiding said carriage also includes at least one guide roll rotatably mounted on a shaft on the underside of said carriage said shaft being substantially perpendicular to said drive shaft such that during operation of said apparatus, said guide roll engages a side wall of said upstanding seam.

7. The apparatus according to claim 6, wherein said means for guiding said carriage along said standing seam includes at least one guide roll rotatably mounted on a shaft substantially perpendicular to said drive shaft such that during the operation of said apparatus said guide roll will engage the portion of said seam to be deformed.

8. The apparatus according to claim 7, wherein said means for guiding said carriage along said standing seam includes a guide member extending from each end of said carriage such that a portion of each guide member is juxtaposed and substantially contiguous with said upstanding seam member.

9. The apparatus according to claim 1, wherein said carriage is provided with a reversible handle so that said apparatus is capable of traversing a seam both forward and backward and it is unnecessary to turn the apparatus around at the end of a seam before starting on the next seam.

10. The apparatus according to claim 1, wherein said drive roller and said forming roller are integral and one piece.

* * * * *